US006131735A

United States Patent [19]

Holtkamp, Jr.

[11] Patent Number: 6,131,735

[45] Date of Patent: Oct. 17, 2000

[54] PACKAGING ARRANGEMENT FOR A PLANT

[75] Inventor: Reinhold Holtkamp, Jr., Nashville, Tenn.

[73] Assignee: Holtkamp Greenhouses, Inc., Nashville, Tenn.

[21] Appl. No.: 09/328,801

[22] Filed: Jun. 9, 1999

[51] Int. Cl.[7] ..... B65D 85/00

[52] U.S. Cl. ..... 206/423; 47/72

[58] Field of Search ..... 206/423, 457, 206/811; 47/72

[56] References Cited

U.S. PATENT DOCUMENTS

| | | | |
|---|---|---|---|
| 1,464,534 | 8/1923 | Lovett, Jr. . | |
| 2,302,259 | 11/1942 | Rothfuss | 41/10 |
| 3,052,063 | 9/1962 | Dunn | 47/38 |
| 5,293,715 | 3/1994 | Kaz | 206/423 X |
| 5,450,707 | 9/1995 | Weder et al. | 53/399 |
| 5,452,560 | 9/1995 | Weder et al. | 53/397 |
| 5,471,816 | 12/1995 | Weder et al. | 53/397 |
| 5,584,162 | 12/1996 | Weder | 206/423 X |
| 5,628,164 | 5/1997 | Weder et al. | 53/397 |
| 5,632,131 | 5/1997 | Weder et al. | 53/399 |
| 5,647,189 | 7/1997 | Weder et al. | 53/399 |
| 5,678,355 | 10/1997 | Mori et al. | 47/84 |
| 5,687,502 | 11/1997 | Weder | 47/72 |
| 5,761,879 | 6/1998 | Weder et al. | 53/399 |
| 5,813,198 | 9/1998 | Weder et al. | 53/465 |
| 5,839,256 | 11/1998 | Weder et al. | 53/399 |
| 5,890,343 | 4/1999 | Weder et al. . | |

*Primary Examiner*—Jacob K. Ackun
*Attorney, Agent, or Firm*—Foley & Lardner

[57] ABSTRACT

A packaging arrangement for a plant facilitating its shipment and merchandising. The packaging arrangement includes a pot having a frustoconical portion and a lip portion, a flexible barrier mounted on the pot at the junction of the frustoconical and lip portions, and an annular elastic member constricting a portion of the barrier that is gather around the stalk of the plant.

13 Claims, 3 Drawing Sheets

PACKAGING ARRANGEMENT FOR A PLANT

BACKGROUND OF THE INVENTION

1. Field of the Invention

The present invention is directed to a packaging arrangement for a plant. In particular, the packaging arrangement facilitates shipping a miniature plant by reducing evaporation from the growth medium in which the plant is rooted. The packaging arrangement also facilitates merchandising the plant by presenting a decorative appearance.

2. Description of the Related Art

It is known to provide a decorative cover for a conventional plant pot so as to provide a more aesthetically pleasing appearance to the pot. Such conventional pots are frequently manufactured from clay or plastic and have a terra cotta color. In order to match the decor in which the plant pot is to be located, a suitable covering is wrapped around the pot so as to hide the pot. Typically, the covering envelops the exterior surface of the pot, including the bottom and side(s) of the pot.

It is also known to extend a portion of the covering onto and across the top lip of the pot, thus entirely eliminating any sight of the pot. Such a covering presents the semblance of a plant growing out of a decorative container rather than out of a pot.

Of course, it is also known to substitute a decorative container for a conventional pot; however, this approach has at least two disadvantages. First, it is often considerably more costly to provide a decorative container than simply to apply a decorative covering to a conventional pot. Second, the decorative pattern of such a container cannot be changed without applying an additional covering.

It is additionally known to gather the extended portions of the cover around the stalk of the plant so as to hide the growth medium, e.g., soil, in which the plant root(s) extend. Often, this is accomplished with a length of yarn or ribbon that is tied in a knot. Again, this is intended to enhance the decorative appearance as compared to a conventional potted plant.

The known coverings suffer from a number of disadvantages including failing to provide anti-evaporative qualities during shipment of the plant, limiting the consumer to the particular combinations of plants and coverings selected by the plant vendor, and wasting material unnecessarily covering the entire exterior surface of the pot.

SUMMARY OF THE INVENTION

An object of the present invention is to provide a packaging arrangement for a plant that facilitates shipping. It is a particular object of the present invention to provide a packaging arrangement that reduces the loss of water due to evaporation from the growing medium in which the plant is rooted.

It is another object of the present invention to provide packaging having an enhanced decorative appearance that uses a minimum amount of material. It is a particular object of the present invention to provide a cover that extends over only the lip of the pot, is constricted around the stalk of the plant, and flares outwardly to form a setting for the plant's flowers or leaves.

These objects, as well as additional objects and advantages that will become apparent from the following detailed description, are accomplished by a packaging arrangement for a plant having a root extending into a growing medium and a stalk projecting out of the growing medium. The packaging arrangement comprises a pot adapted to contain the growing medium, the pot having a frustoconical portion, an end portion substantially occluding the smaller end of the frustoconical portion, and a lip portion projecting outwardly from a larger end of the frustoconical portion; an impermeable barrier adapted to retain the growing medium in the pot, the barrier includes a flexible and substantially inelastic sheet defining an aperture configured to correspond to the larger end of the frustoconical portion; and an annular elastic member adapted to gather a peripheral portion of the sheet around the stalk, the elastic member defining a constricted portion of the barrier between the aperture and the peripheral portion.

The objects and advantages of the present invention will be set forth in the description that follows, and in part will be readily apparent to those skilled in the art from the description and drawings, or may be learned by practice of the invention. These objects and advantages of the invention may be realized and obtained by means of the instrumentalities and combinations particularly pointed out in the appended claims.

BRIEF DESCRIPTION OF THE DRAWINGS

FIG. 1A is a perspective view of a pot according to the present invention.

FIG. 1B is a plan view of a barrier according to the present invention.

FIG. 1C is a perspective view of an elastic member according to the present invention.

DETAILED DESCRIPTION OF THE PREFERRED EMBODIMENT

Figure 1C:
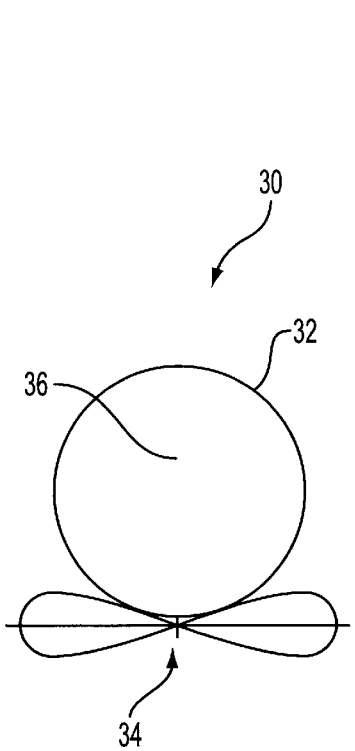
FIGS. 1A–1C show an unassembled arrangement of components for the packaging arrangement according to the present invention.
Figure 1B:
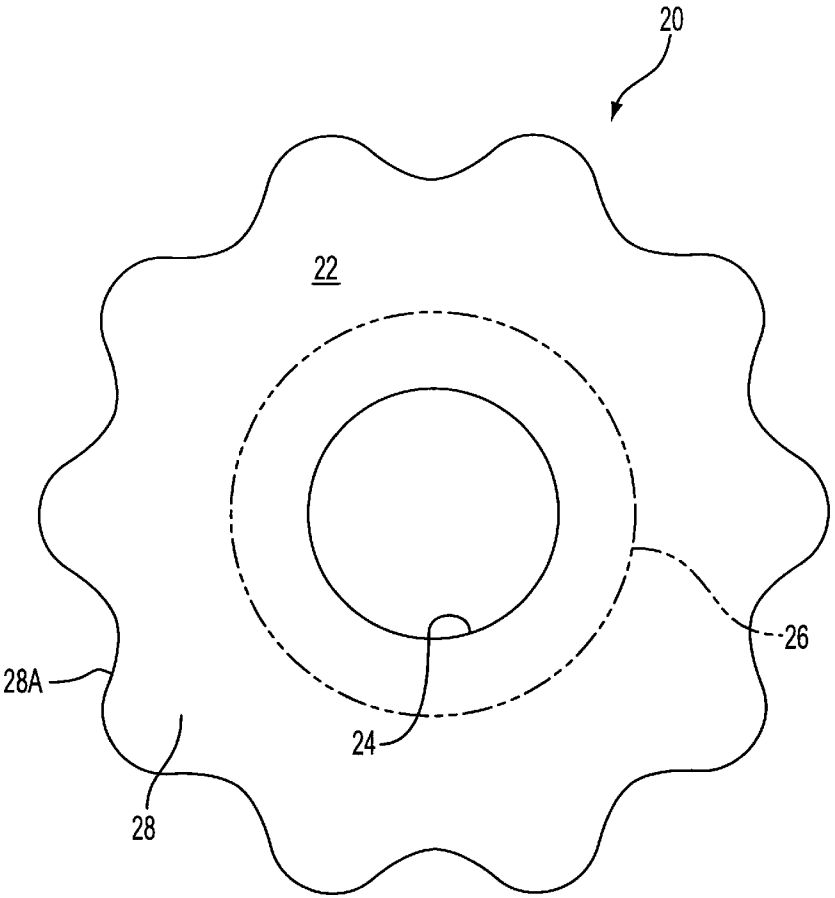
Figure 1A:
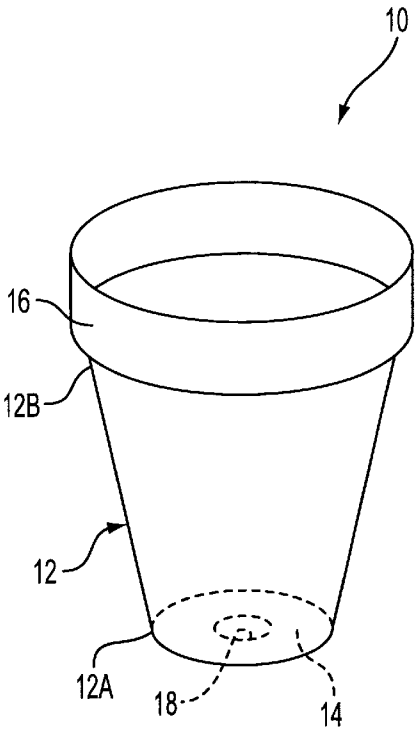

Referring to FIG. 1A, a pot 10 according to the present invention comprises a frustoconical portion 12, an end portion 14, and a lip portion 16. The frustoconical portion 12 extends from a smaller end 12A to a larger end 12B. The end portion 14 substantially occludes the smaller end 12A. The lip portion 16 projects outwardly from the larger end 12B. A hole 18 through the end portion 14 allows the absorption of water into a growing medium (not shown) contained in the pot 10. The hole 18 also allows the expulsion of excess water from the growing medium.

According to a preferred embodiment, the pot 10 is sized appropriately for a miniature plant (not shown). According to a most preferred embodiment of the present invention, the diameter of the lip portion 16 is less than four inches, and preferably in the range of four centimeters to three inches. Such miniature plant pots are able to contain only small amounts of the growing medium, which in turn limits the supply of water that the growing medium can make available to the plant. The inventor of the present invention has recognized that, in these miniature pots, the amount of water that evaporates from the growing medium far exceeds the amount of water lost directly by the plant. Thus, the present invention addresses the loss of significant amounts of the limited supply of water during shipping and merchandising.

Preventing evaporation from the growing medium is primarily accomplished by a barrier 20 according to the present invention. Referring to FIG. 1B, the barrier 20 comprises a sheet 22 defining an aperture 24. According to a preferred embodiment of the present invention, the sheet 22 is constructed of a material that is 1) impermeable to water, 2) flexible or pliable (i.e., capable of being bent, folded, rumpled, gathered, etc.), and 3) substantially inelastic or unyielding (i.e., not easily distorted by stretching or compression). According to a most preferred embodiment of the present invention, the sheet 22 is a plastic film that is also impermeable to air. The plastic film may be transparent (i.e., clear), translucent (e.g., prismatic, colored, or partially imprinted with a design), or opaque (e.g., solid or reflective). The aperture 24 is sized and shaped so as to have a configuration that corresponds to the size and shape of the larger end 12B. Thus, there is a snug fitting relationship between the aperture 24 and the larger end 12B.

FIG. 1C shows an elastic member 30 according to the present invention. According to a preferred embodiment of the present invention, the elastic member 30 is formed by a segment of elastic cord 32 tied into a knot 34. The size of the opening 36 defined by the elastic member 30 is selected with respect to the size of the plant stalk(s) to be encircled. According to a most preferred embodiment of the present invention, the size of the opening 36 is selected so as to approximate the diameter of the stalk(s) without compressing the fibers of the plant stalks.

Figure 2:
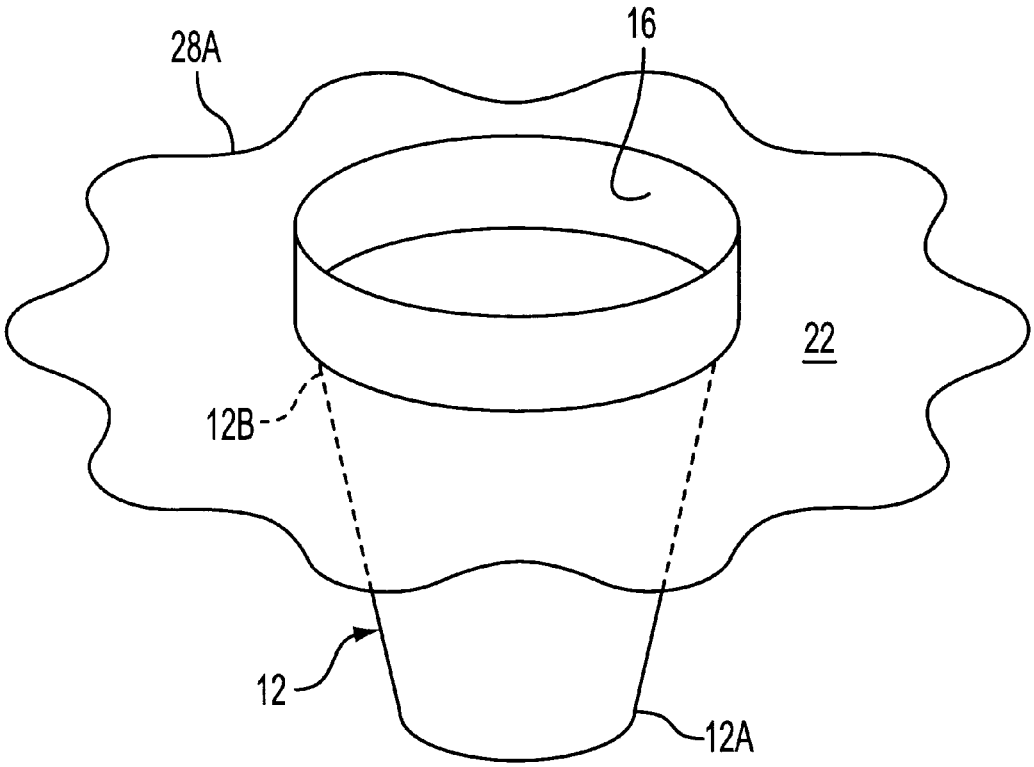
FIG. 2 is a perspective view of the packaging arrangement according to the present invention in an intermediate assembled arrangement.

Referring to FIG. 2, assembly of the packaging arrangement according to the present arrangement begins by inserting the pot 10 into the aperture 24. Specifically, the smaller end 12A of the frustoconical portion 12 is passed through the aperture. The frustoconical portion 12 continues to pass through the aperture until the larger end 12B is snuggly received in the aperture 24. Because the sheet 22 is substantially inelastic, the barrier 20 cannot continue passing onto the larger diameter lip portion 16, and remains fitted on the pot 10 at the larger end 12B of the frustoconical portion 12.

Figure 3:
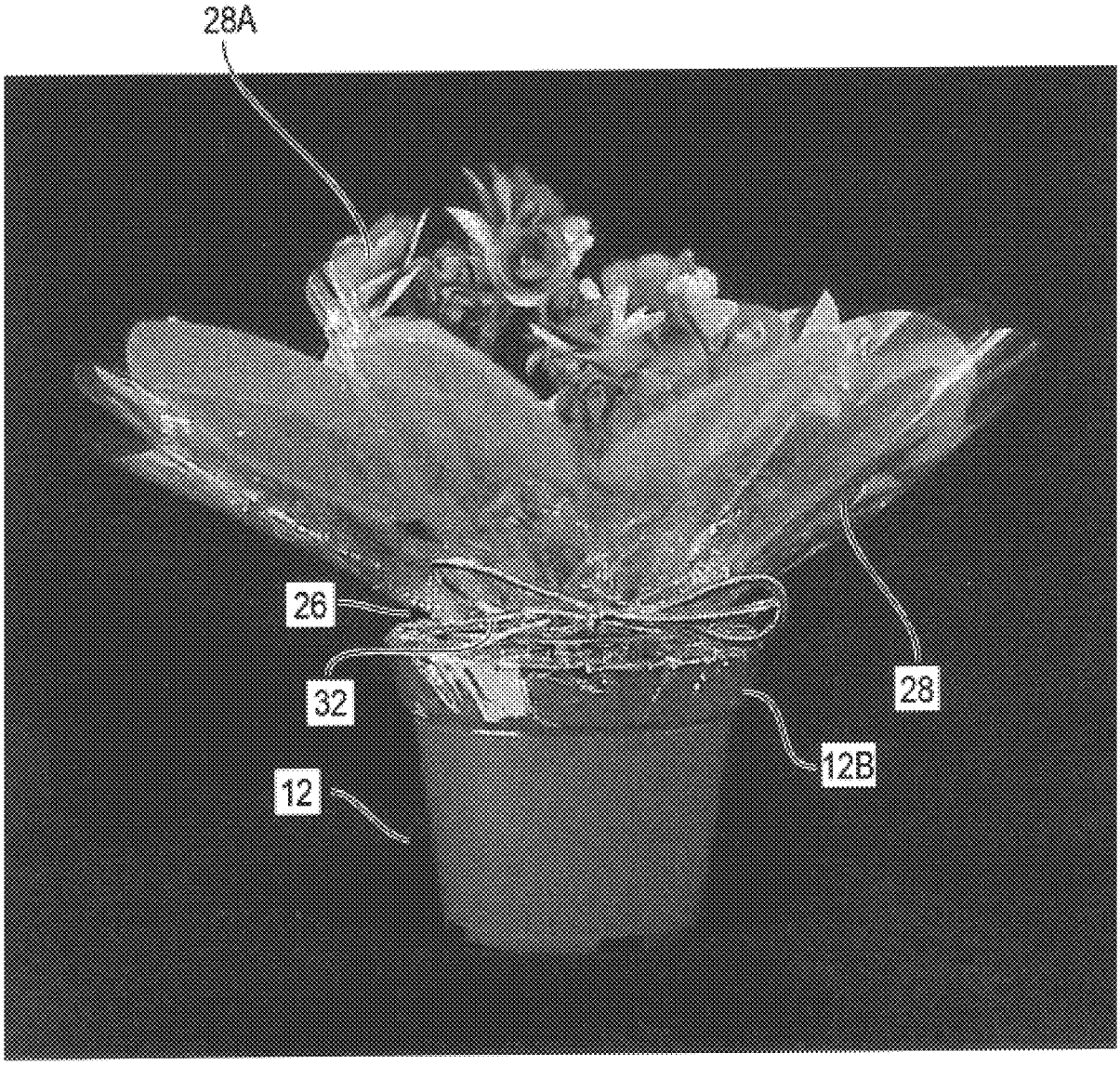
FIG. 3 is a truncated perspective view of the packaging arrangement according to the present invention in an assembled arrangement.

Referring to FIG. 3, the barrier 20 is reshaped to extend upwardly over the lip portion 16, and gathered around the plant stalk. It is possible to reshape and gather the barrier 20 because the sheet 22 is flexible. The elastic member 30, in the form of an annulus, is then positioned so as to constrict a portion 26 of the sheet 22 with respect to the plant stalk. The constricted portion 26 of the sheet 22 lies radially between the aperture 24 and a portion 28 of the sheet 22 near a peripheral edge 28A. The portion of the water impenetrable sheet 22 lying between the aperture 24 and the constricted portion 26 overlies the growing medium in the pot 10. Thus, a barrier is formed that reduces the loss of water available to the plant as a result of evaporation from the growing medium. According to a preferred embodiment of the present invention, the sheet 22 significantly occludes the opening between the pot 10 and the plant.

According to a preferred embodiment of the present invention, the peripheral portion 26 is then further reshaped to flare outwardly from the constricted portion 26. This flared peripheral portion 26 defines an aesthetically pleasing setting between the pot 10 with the growing medium and the flowers and leaves of the plant. According to a most preferred embodiment of the present invention, the peripheral portion 28 has a ruffled appearance as a result of being flared outwardly from the constricted portion 26. Providing the peripheral edge 28A with a scalloped pattern may further enhance the aesthetic qualities. Of course, other decorative patterns and treatments may be provided at the peripheral edge 28A.

As discussed above, the sheet 22 may be manufactured from a plastic film that is clear, colored, prismatic, imprinted, solid, reflective, etc. Additionally, the general shape of the peripheral edge 28A, i.e., without an edge pattern or treatment, may be circular, triangular, rectangular, etc. An endless variety of material and configuration combinations are possible for augmenting the aesthetic qualities of packaging arrangement according to the present invention.

The selections of a particular color, material, shape, and knot configuration for the elastic member 30 also contributes to the aesthetic qualities. According to a preferred embodiment of the present invention, a length of golden elastic tie cord tied in a bowknot provides a particularly pleasing appearance.

An advantage of the present application over known decorative plant pot covers is that the size of the sheet 22 is smaller. Specifically, far less material is required for the sheet 22 because it does not extend over the frustoconical portion 12 and end portion 14 of the pot 10.

Another advantage of the present application is that the hole 18 through the end portion 14 of the pot 10 is accessible in the fully assembled arrangement of the packaging. This ensures that additional supplies of water may be made available to the plant without disturbing the functional and aesthetic qualities of the assembled packaging.

Additional advantages and modifications will readily occur to those skilled in the art. Therefore, the invention in its broader aspects is not limited to the specific details and representative devices, shown and described herein. Accordingly, various modifications may be made without departing from the spirit and scope of the general inventive concept as defined by the appended claims and their equivalents.

We claim:

1. A packaging arrangement for a plant having a root extending into a growing medium and a stalk projecting out of the growing medium, the packaging arrangement comprising:

a pot adapted to contain the growing medium, the pot having a frustoconical portion, an end portion substantially occluding the smaller end of the frustoconical portion, and a lip portion projecting outwardly from a larger end of the frustoconical portion;

an impermeable barrier adapted to retain the growing medium in the pot, the barrier includes a flexible and substantially inelastic sheet defining an aperture configured to correspond to the larger end of the frustoconical portion; and an annular elastic member adapted to gather a peripheral portion of the sheet around the stalk, the elastic member defining a constricted portion of the barrier between the aperture and the peripheral portion.

2. The packaging arrangement according to claim 1, wherein the peripheral portion flares outwardly relative to the constricted portion.

3. The packaging arrangement according to claim 1, wherein the lip portion has a diameter less than four inches.

4. The packaging arrangement according to claim 3, wherein the lip portion diameter is in a range between four centimeters and three inches.

5. The packaging arrangement according to claim 1, wherein the barrier is impermeable to water.

6. The packaging arrangement according to claim 5, wherein the barrier is impermeable to air.

7. The packaging arrangement according to claim 1, wherein the barrier is comprises a sheet of plastic film.

8. The packaging arrangement according to claim 7, wherein the plastic film is transparent.

9. The packaging arrangement according to claim 7, wherein the plastic film is translucent.

10. The packaging arrangement according to claim 9, wherein the plastic film is colored.

11. The packaging arrangement according to claim 9, wherein the plastic film is imprinted.

12. The packaging arrangement according to claim 1, wherein the elastic member is detachable from the barrier.

13. The packaging arrangement according to claim 1, wherein the elastic member includes a decorative knot.

* * * * *